US006564401B1

(12) United States Patent
Weinman

(10) Patent No.: US 6,564,401 B1
(45) Date of Patent: May 20, 2003

(54) BRACKET FOR SECURING A HEADBOARD TO A BED FRAME

(75) Inventor: Adam Michael Weinman, Tampa, FL (US)

(73) Assignee: American Bedding Industries, Inc., Tampa, FL (US)

( * ) Notice: Subject to any disclaimer, the term of this patent is extended or adjusted under 35 U.S.C. 154(b) by 0 days.

(21) Appl. No.: 10/104,334

(22) Filed: Mar. 25, 2002

(51) Int. Cl.[7] ..... A47C 19/02

(52) U.S. Cl. ..... 5/53.1; 5/132; 5/238; 5/304; 5/282.1

(58) Field of Search ..... 5/288, 289, 293, 5/304, 53.1, 281, 282.1, 285, 8, 132

(56) References Cited

U.S. PATENT DOCUMENTS

| | | | | | |
|---|---|---|---|---|---|
| 2,523,987 | A | * | 9/1950 | Fox | 5/8 |
| 2,697,233 | A | | 12/1954 | Christenson | |
| 2,745,116 | A | * | 5/1956 | Jackson | 5/131 |
| 2,784,421 | A | * | 3/1957 | Fredman | 5/131 |
| 2,845,636 | A | * | 8/1958 | Iaquinta et al. | 5/132 |
| 3,008,176 | A | * | 11/1961 | Paine et al. | 16/273 |
| 3,329,975 | A | * | 7/1967 | Hooker | 5/8 |
| 3,644,948 | A | | 2/1972 | Fredman | |
| 3,740,776 | A | | 6/1973 | Lazarus | |
| 3,748,668 | A | | 7/1973 | Rudin | |
| 4,160,296 | A | | 7/1979 | Fogel | |
| 4,354,287 | A | | 10/1982 | Fredman | |
| 4,467,486 | A | | 8/1984 | Schatz | |
| 4,501,033 | A | | 2/1985 | Kessel et al. | |
| 4,942,633 | A | | 7/1990 | Thomas et al. | |
| 5,163,968 | A | | 11/1992 | Lafferty | |
| 5,261,507 | A | | 11/1993 | Williams et al. | |
| 5,645,258 | A | | 7/1997 | Flowers | |
| 6,089,651 | A | | 7/2000 | Carmen | |

* cited by examiner

*Primary Examiner*—Michael F. Trettel
(74) *Attorney, Agent, or Firm*—Diller, Ramik & Wight

(57) ABSTRACT

A bracket is provided for use in pairs to secure a headboard to a bed frame. The bracket includes a first bracket assembly defined by relatively U-shaped pivotally connected first and second bracket members and a second bracket assembly defined by pivotally connected relatively shallow U-shaped third and fourth bracket members. The second and fourth bracket members are interconnected by relatively slidable first and second connector members of a connector assembly which can be fixed in selective positions of relative adjustment. The first and third bracket members are secured to a respective bed frame and headboard and the relative pivoting and sliding connections allow two such brackets to be utilized for any sized bed, be it single, queen, king, etc.

24 Claims, 5 Drawing Sheets

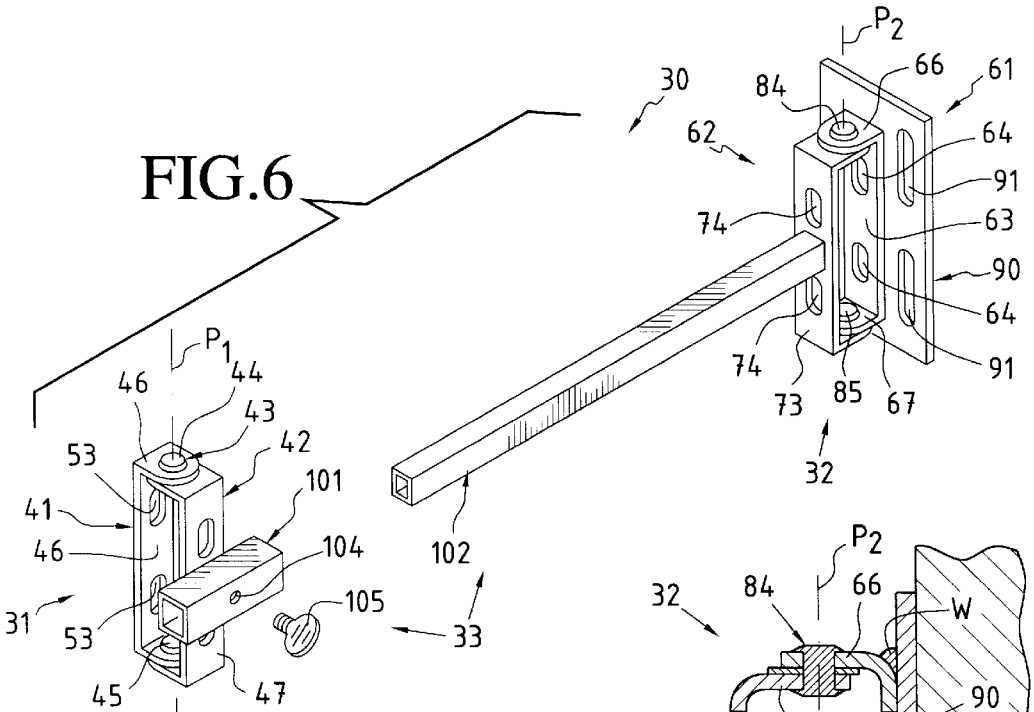
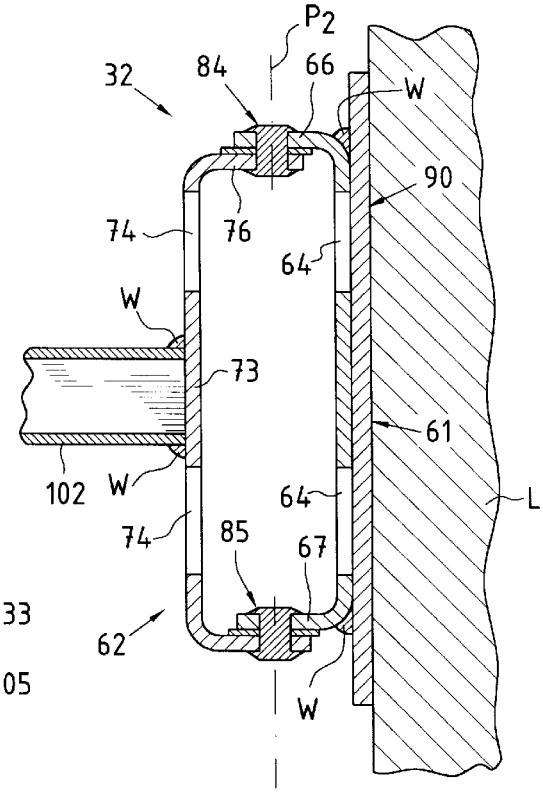
FIG.8
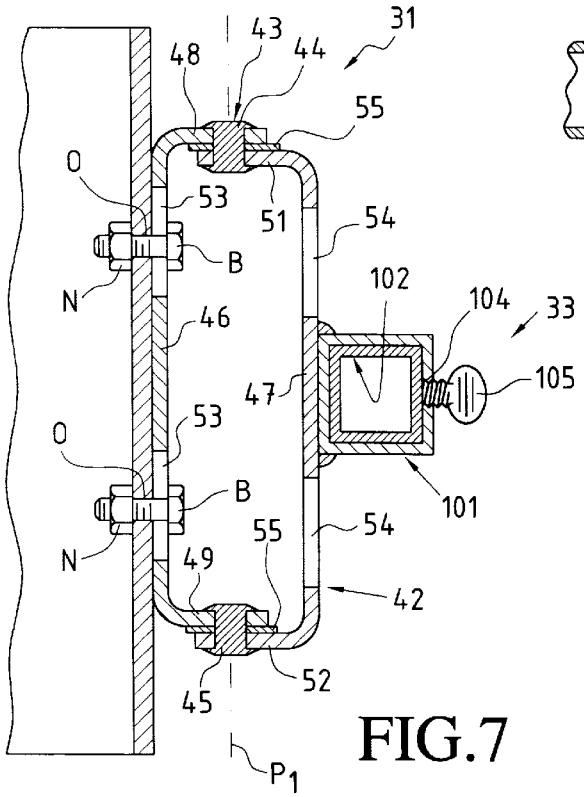
FIG.7

BRACKET FOR SECURING A HEADBOARD TO A BED FRAME

BACKGROUND OF THE INVENTION

Conventional beds, including adjustable beds, come in a variety of sizes, such as single, queen, king, etc. Such conventional beds are of standard sizes, as are the frames, box springs and mattresses therefor. Headboards and footboards are also of widths which correspond to the beds, be they single, queen, king or the like. A variety of different types of mechanisms have been utilized in the past for securing headboards, as well as footboards, to bed frames.

Insofar as a manufacturer of beds of different widths is concerned, it would be highly advantageous to utilize a single headboard/foot board attaching mechanism or bracket to secure a respective headboard/footboard to a bed frame of a particular width, be it single, queen, king or the like. A variety of headboard brackets for securing headboards to bed frames are represented in the following patents:

| | |
|---|---|
| 2,697,233 | Christenson |
| 3,644,948 | Fredman |
| 3,740,776 | Lazarus |
| 3,748,668 | Rudin |
| 4,160,296 | Fogel |
| 4,354,287 | Fredman |
| 4,467,486 | Schatz |
| 4,501,033 | Kessel et al. |
| 4,942,633 | Thomas et al. |
| 5,163,968 | Lafferty |
| 5,261,507 | Williams et al. |
| 5,645,258 | Flowers |
| 6,089,651 | Carmen |

All of the foregoing brackets for securing headboards to bed frames possess inherent disadvantages and, thus, an objection of this invention is to provide a novel and unobvious bracket for securing headboards of different widths to respective bed frames of such corresponding widths in a relatively quick, easy and fool-proof manner and manufacture such bracket at a reasonable cost.

BRIEF SUMMARY OF THE INVENTION

A novel bracket constructed in accordance with this invention for securing a headboard to a bed frame includes a first bracket assembly, a second bracket assembly and a connector assembly which selectively variably connects the first and second bracket assemblies to each other. The first bracket assembly includes first and second bracket members which are pivoted relative to each other, as does the second bracket assembly with the pivots preferably being in substantially parallel relationship to each other in the assembled condition. The connector assembly includes a first connector member connected to the first bracket assembly and a second connector member connected to the second bracket assembly with the first and second connector members being in slidable relationship to each other.

Two brackets constructed in the manner aforesaid are connected one each to opposite lateral sides of a headboard and to opposite lateral sides of the head end of an associated bed. A first bracket member of the first bracket assembly of each bracket is secured to the bed frame and a third bracket member of the second bracket assembly of each bracket is secured to an associated headboard. The two brackets are so connected between the bed frame and the headboard so as to substantially align the headboard with the bed frame, as is conventional. Furthermore, due to the two vertical connecting pivots and the sliding connection of the connector members, the distance between the headboard and the head of the bed frame can be readily adjusted and, more importantly, the lateral or width distance between the first bracket assemblies of the two brackets and the lateral or width distance between the second bracket assemblies of the brackets can be selectively lengthened or shortened, again due to the slidable connection between the connector members of the connector assembly. A connector member of each of the connector assemblies is relatively long and this allows the first and second bracket assemblies of each bracket member to be moved closer toward each other to accommodate narrow width beds, such as a single bed, whereas extending the connector assemblies relative to each other increases the distances between the first and second bracket assemblies to allow the same brackets to be utilized for connecting wider headboards (king) to correspondingly wide beds.

A bracket so constructed is relatively inexpensive to manufacture, particularly when constructed from sheet metal and/or extruded metal tubes, and/or tough, high strength polymeric/copolymeric synthetic plastic material. The two connector members of the connector assembly are preferably of a generally polygonal cross-sectional configuration which prevents relative rotation therebetween, and the latter prevents inadvertent/accidental tilting or "cocking" of the headboard and its associated bed frame.

Each of the first and second bracket assemblies are also of an identical interchangeable construction with each bracket assembly being formed of two substantially shallow U-shaped bracket members defined by a bight or central portion and two legs or leg portions with the leg portions of the first and second bracket members of each bracket assembly being connected by an associated pivot pin. The latter interchangability of the bracket members also reduces the cost of construction and eases repairs. Stockpiling of parts is also appreciably reduced.

The first and second connector members of the connector assembly are also preferably secured in any position of relatively telescopic adjustment to assure that once in place the headboard and bed frame will maintain such spacing indefinitely. Preferably, the securing means between the first and second connector members is a set screw which threads into the first connector member and bites into an external surface of the second connector member to rigidly unite the two members to each other.

All of the bracket assembly members have at least one pair of elongated slots through which fasteners, such as bolts and/or nuts and/or screws, can be fastened for securing the bracket assemblies to an associated headboard and bed frame. The vertical orientation and elongation of the openings or apertures in the bracket members are preferably located in the bight portions or central portions thereof and achieve limited relative vertical movement between the bracket assemblies and the bed frame and headboard to assure proper vertical orientation therebetween.

BRIEF DESCRIPTION OF THE DRAWINGS

FIG. 6 is an exploded perspective view, and illustrates one of the two identical brackets of FIGS. 1 through 5, and illustrates first and second bracket members of a first bracket assembly, third and fourth bracket members of a second bracket assembly, and a pair of relatively slidable first and second connector members of a connector assembly.

FIG. 7 is an enlarged fragmentary cross-sectional view taken generally along line 7—7 of FIG. 4, and illustrates two substantially shallow U-shaped first and second bracket members of the first bracket assembly pivotally connected to each other, and the first connector member welded to the second bracket member and telescopically receiving therein the second connector member secured in one of many positions of relative telescopic adjustment by a threaded set screw.

FIG. 8 is an enlarged fragmentary cross-sectional view taken generally along line 8—8 of FIG. 4, and illustrates the second connector member welded to the fourth bracket member of the second bracket assembly, pivots connecting the third and fourth bracket members, and a mounting plate member welded to the third bracket member and defining a portion thereof.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENT

Figure 1:
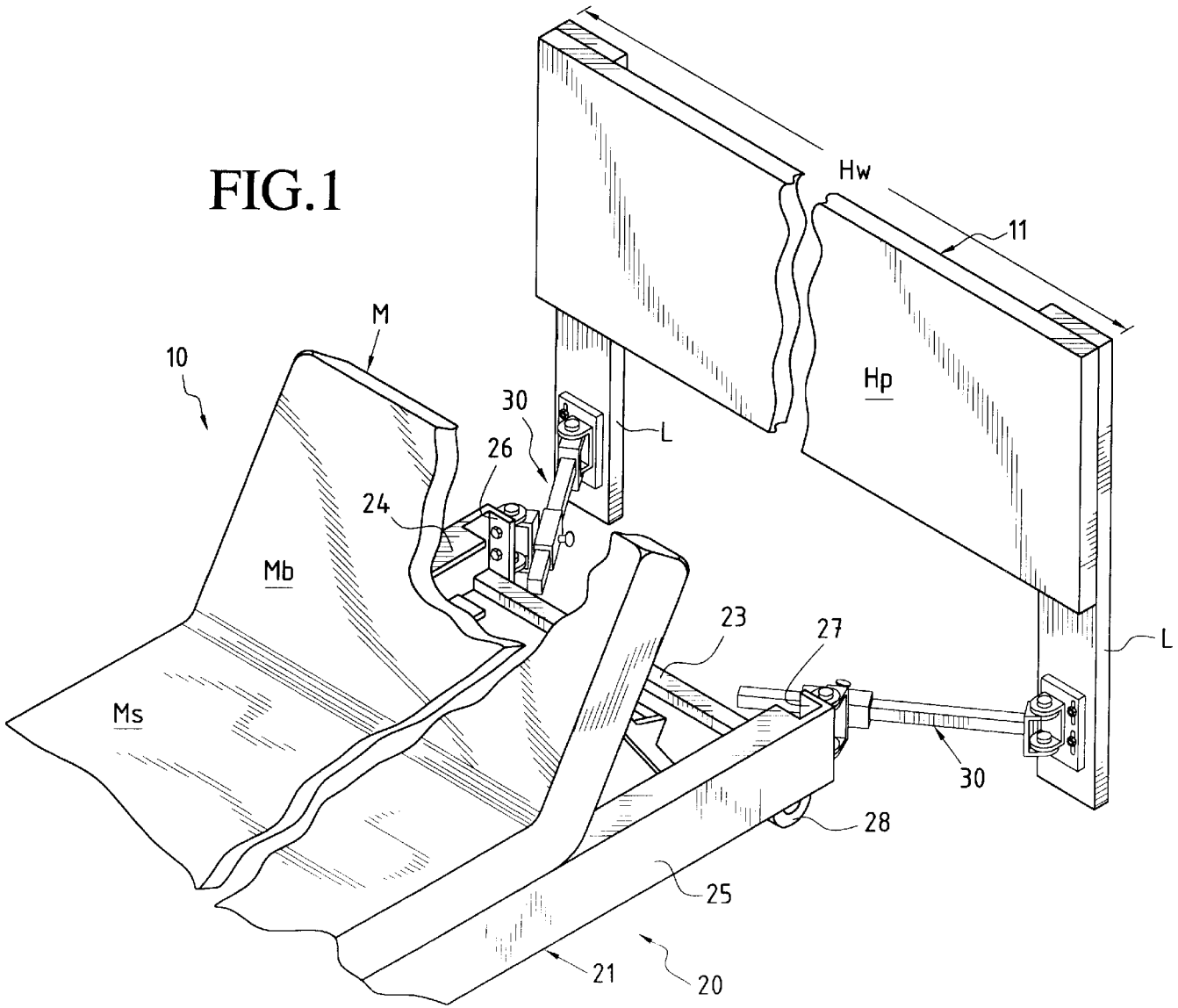
FIG. 1 is a fragmentary perspective view of an adjustable bed with a head portion thereof in an inclined position and an associated headboard, and illustrates two brackets of the invention each defined by a first bracket assembly, a second bracket assembly and a connector assembly securing the headboard to a bed frame of the adjustable bed.
Figure 2:
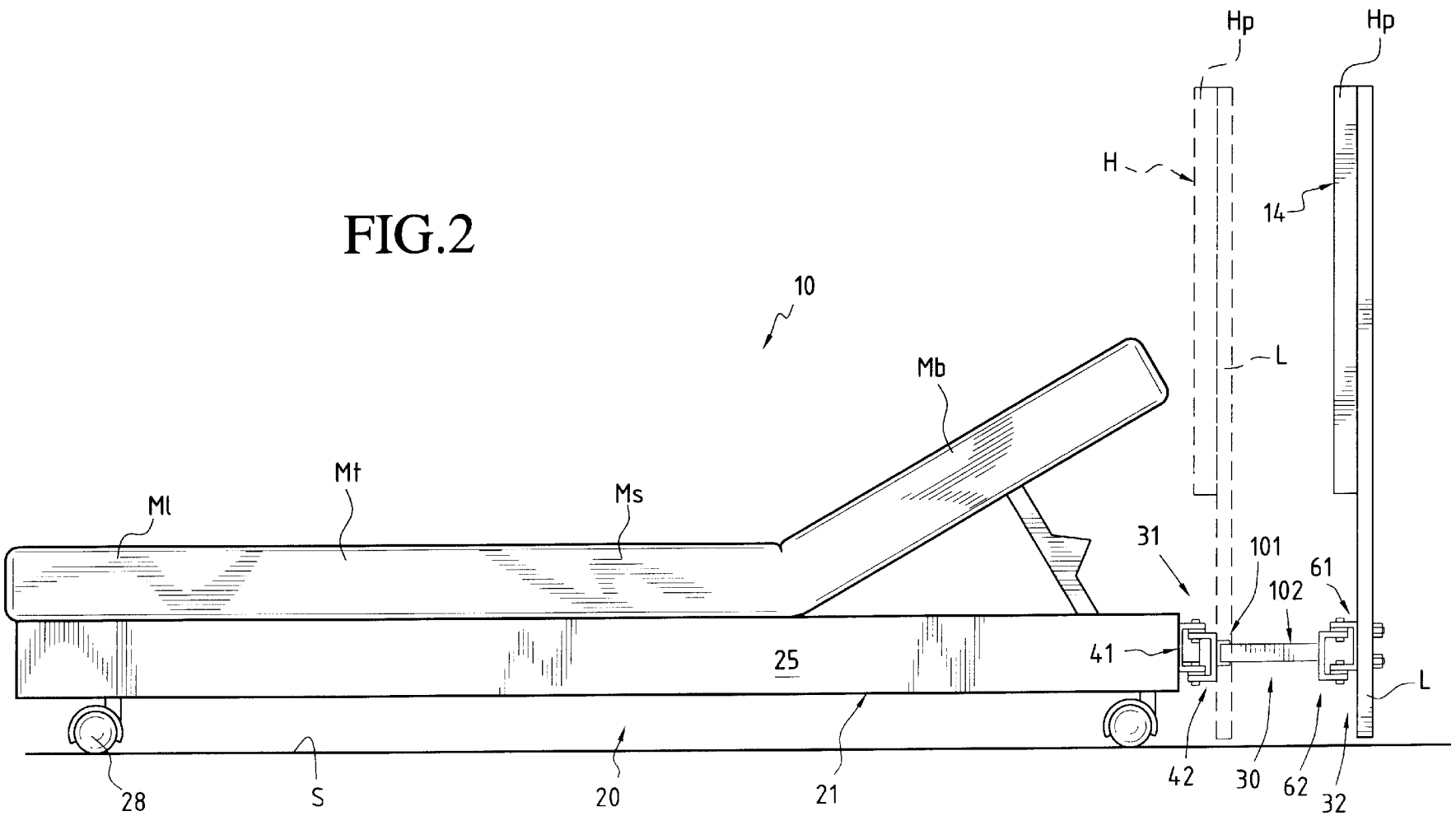
FIG. 2 is a side elevational view of the bed, headboard and one of the brackets of FIG. 1, and illustrates in solid lines the headboard spaced away from a head end of the bed frame incident to its assembly thereto, and in phantom outline repositioning closer to the bed frame to complete the assembly between the two.

An adjustable or articulated bed is illustrated in FIGS. 1 and 2 of the drawings and is generally designated by the reference numeral 10. The adjustable bed 10 includes an adjustable bed frame 20 upon which rests a mattress M of a conventional construction, including a back rest mattress portion Mb, a seat mattress portion Ms, a thigh mattress portion Mt, and a leg mattress portion Ml. The mattress M can be moved between a substantially horizontally disposed position (not shown) and an adjusted or articulated position, as shown in FIGS. 1 and 2.

The adjustable bed 10 and the adjustable bed frame 20, including the mechanisms for moving the adjustable frame 20, are preferably constructed and arranged in accordance with the details of U.S. Pat. No. 6,276,011 granted on Aug. 21, 2001 to Santino Antinori. Among the components of the adjustable bed frame 20 is a main frame 21 which includes a head end cross bar 23 which is welded to side bars 24, 25 having respective end flanges 26, 27 located in a common vertical plane and in opposing relationship to each other (FIGS. 1 and 3 through 5). A plurality of identical castors or rollers 28 are secured to each corner of the main frame 21 to facilitate rolling movement of the bed 10 to desired locations.

Though the bed 10 can be utilized without the use of a headboard, in keeping with this invention a headboard H (FIGS. 1 and 2) is illustrated schematically to include a main horizontally disposed headboard plate Hp and a pair of opposite generally parallel legs L. The overall width Hw (FIG. 1) of the headboard H is measured from the outside surfaces (unnumbered) of the headboard plate Hp and/or of the legs L, and the latter width corresponds to the width Fw of the main frame 21, as measured from the outside surfaces (unnumbered) of the side rails 24, 25 (FIGS. 3 through 5 of the drawings) depending upon the size of the bed 10, be it single, queen, king or the like. The width Hw of the headboard H must necessarily match the main frame width Fw so that the outside edges (unnumbered) of the legs L of the headboard H and the outer surfaces of the side bars 24, 25 are in substantially common vertical planes. Therefore, the manufacturer of a variety of different sizes of beds not only manufactures matching bed frames and headboards, but must utilize appropriate brackets for securing the different sizes of headboards to correspondingly sized beds. The present invention provides a novel bracket 30 which is utilized in pairs to secure a headboard H of any size (single, queen, king, etc.) to its corresponding size bed frame 20, and each bracket 30 is equally adapted for use with articulated beds and non-articulated conventional beds and their associated headboards (or footboards).

A bracket 30 of the invention is fully illustrated in FIG. 6 of the drawings and comprises a first bracket assembly 31, a second bracket assembly 32 and a connector assembly 33 for selectively variably connecting the first and second bracket assemblies 31, 32, respectively, to each other.

The first bracket assembly 31 includes a first bracket member 41, a second bracket member 42, and first pivot means 43 in the form of individual pivots 44, 45 (FIG. 7) pivotally interconnecting the bracket members 41, 42 to each other. Each of the first and second bracket members 41, 42, respectively, is of a generally shallow U-shaped configuration defined by a bight or central portion 46, 47, respectively, and opposite substantially parallel legs or arms 48, 49; 51, 52. Elongated vertically aligned slots 53, 53 are formed in the bight portion 46 of the first bracket member 41 and similar vertically aligned elongated slots 54, 54 are formed in the bight portion 47 of the second bracket member 42. A washer 55 (FIG. 7) is located between the arms 48, 51 through which passes the pivot pin 44 and a like washer 55 is sandwiched between the arms 49, 52 through which passes the pivot pin 45.

The second bracket assembly 32 is constructed substantially identically to the first bracket assembly 31 and includes a third bracket member 61 and a fourth bracket member 62, each of a generally shallow U-shaped cross-sectional configuration. The third bracket member 61 is defined by a bight or central portion 63 having an aligned pair of elongated slots or openings 64, 64 (FIGS. 6 and 8) and opposite generally parallel legs or arms 66, 67.

Similarly, the fourth bracket member 62 includes a bight or central portion 73 having a pair of elongated vertically aligned slots or openings 74, 74 and opposite generally parallel arms or legs 76, 77. The arms 66, 76 and 67, 77 are pivotally connected by pivot means in the form of respective pivot pins 84, 85. A mounting plate member 90 of a rectangular configuration (FIG. 6) having a pair of vertically aligned elongated slots or openings 91, 91 is secured to the bight portion 63 of the third bracket member 64 by conventional welds W (FIGS. 8).

The pivot pins 44, 45 (FIGS. 6 and 7) define a first pivot axis P1 which is substantially parallel to a second pivot axis P2 (FIGS. 6 and 8) defined by the pivot pins 84, 85. When two of the brackets 30 are utilized to secure the headboard H to the main frame 21 (FIG. 1), the axes P1, P2 are located substantially vertically.

The connector assembly 33 (FIGS. 6 and 7) includes a first connector member 101 and a second connector member 102 each of a tubular, polygonal, preferably square configuration. The internal surface (unnumbered) of the first connector member 101 is sized to snugly, nonrotatably slidingly receive the second connector member 102 and thereby define cooperative means for effecting relative sliding movement of the first and second connector members 101,102, respectively. Appropriate welds W secure the first connector member 101 to the central portion 47 of the second bracket member 42 of the first bracket assembly 31 (FIG. 7) while similar connecting means in the form of a weld W secures the second connector member 102 to the central portion 73 of the fourth bracket member 62 of the second bracket assembly 32 (FIG. 8). A threaded aperture 104 (FIGS. 6 and 7) threadedly receives a thumbscrew 105 which when tightened bears against the second connector member 102 and retains the same in any relative position of adjustment with respect to the first connector member 101.

Headboard to Bed Frame Assembly

Irrespective of whether the bed 10 is an articulated bed or a conventional non-articulated bed, and irrespective of the size thereof, two of the brackets 30 are utilized to secure the headboard H to the main frame 21 at a position relatively spaced from each other (FIGS. 3 and 5) during assembly and thereafter effect relative movement and subsequent locking to retain the headboard H in an in-use position (phantom outline in FIG. 1 and FIG. 4) intimately adjacent the head end (unnumbered) of the bed 10. A level can be placed along either of the vertical edges (unnumbered) of the center portion 46 of each of the brackets 30 to assure that the longitudinal axes (unnumbered) of both brackets 30 are substantially vertical which also assures that the first pivot axes P1, P1 thereof are also vertical and in turn assures that the axis (unnumbered) of each of the first connector members 101 of each connector assembly 33 is substantially horizontal. Each bight portion 46 is fastened by bolts B and nuts N (FIGS. 1 through 5 and 7) to openings O (FIG. 7) in the end flanges 26, 27 thereby securing each first bracket assembly 31, 31 to each of the end flanges 26, 27.

Figures 3, 4:
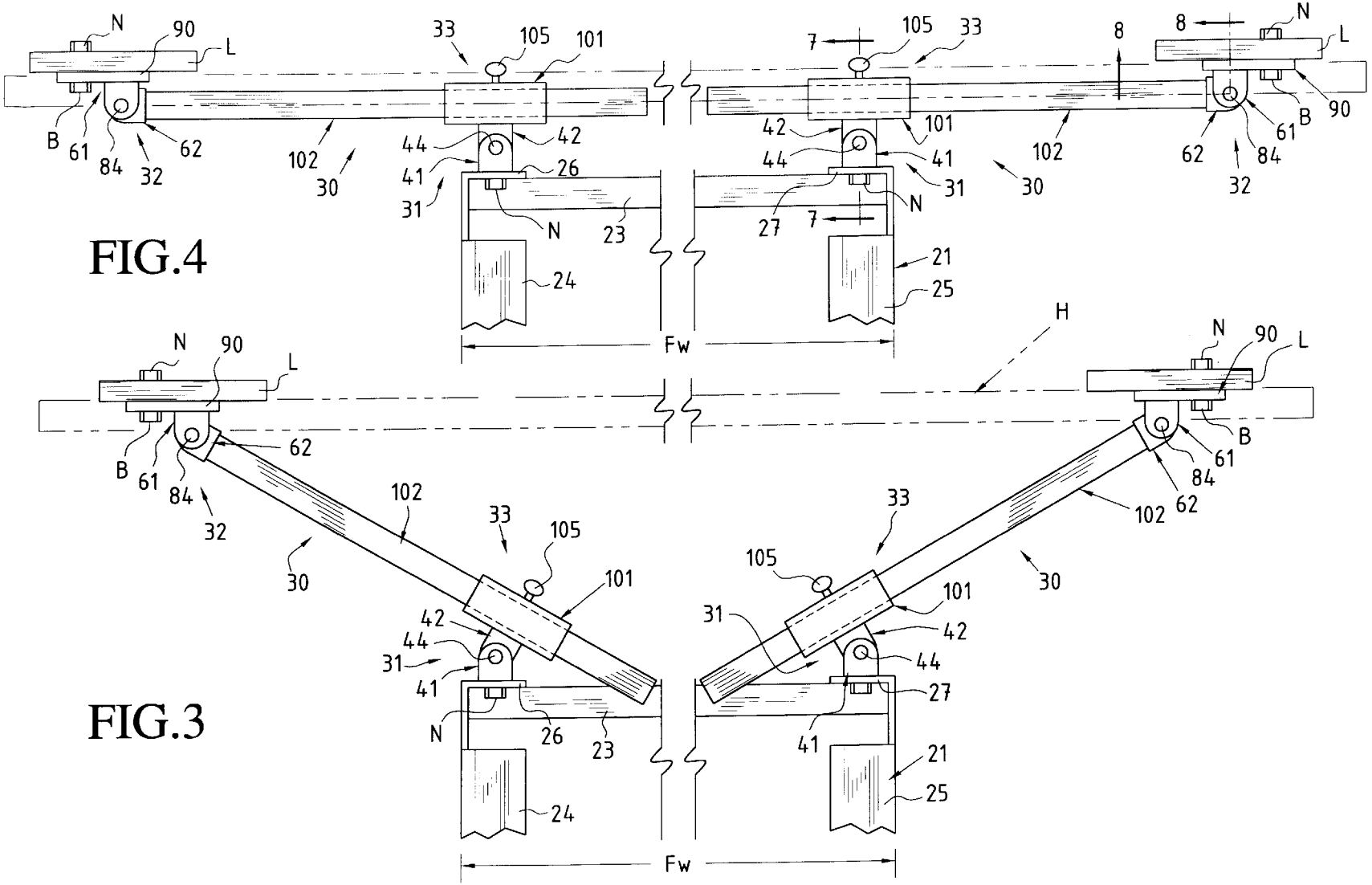
FIG. 3 is a fragmentary top plan view, slightly enlarged, looking downwardly in FIG. 2, and illustrates the relationship of the first and second bracket assemblies and the connector assembly relative to the headboard and the bed frame prior to movement to the in-use position thereof.
FIG. 4 is a fragmentary top plan view, similar to FIG. 3, and illustrates the in-use position of the bracket.
Figure 5:
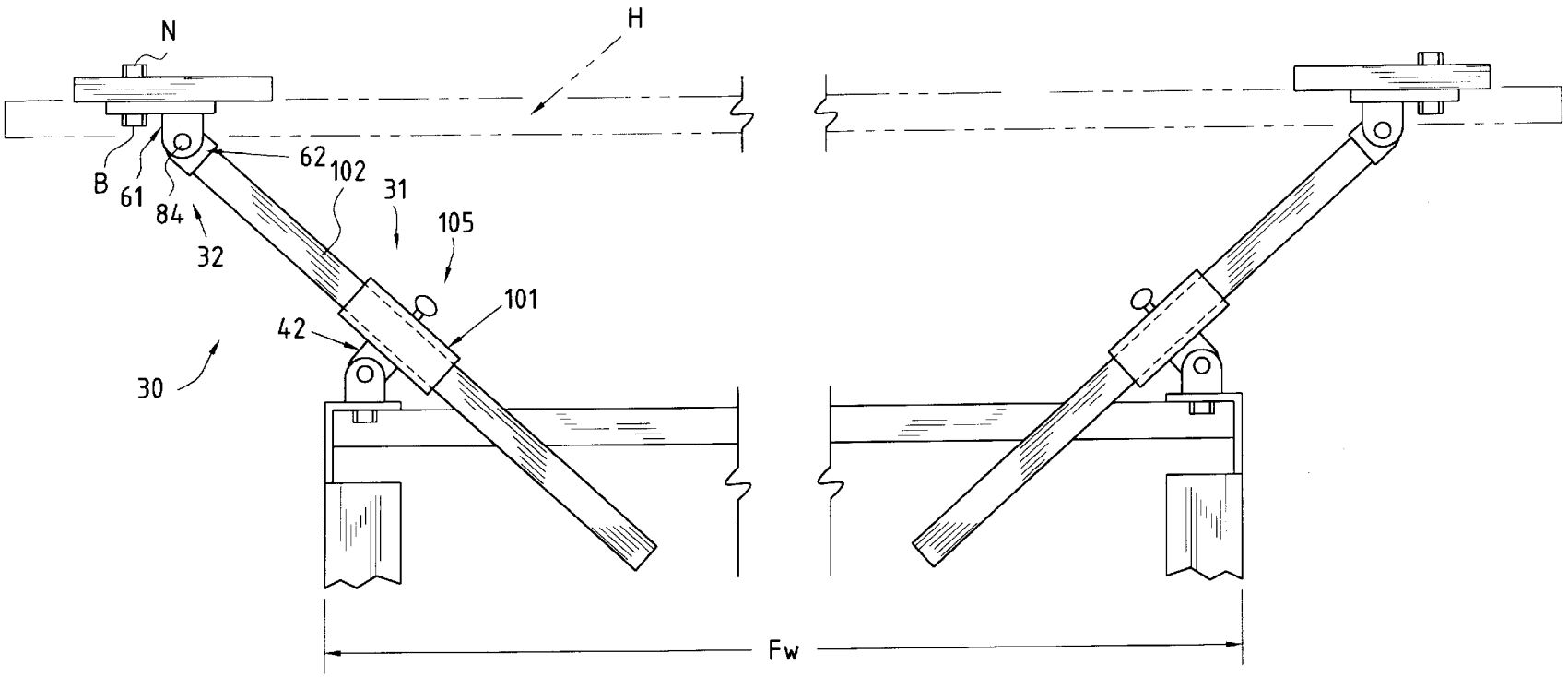
FIG. 5 is a fragmentary top plan view, similar to FIGS. 3 and 4, and illustrates an intermediate position of two brackets secured to a narrow (single) bed.

The second connector member 102 of each bracket 30 is slid into the first connector member 101 (FIGS. 3 through 5). In the case of a narrow bed 10 and a narrow headboard H (FIG. 5), the second connector member 102 is slid into the first connector member 101 a considerable distance whereas for a wider bed 10 (FIG. 3) and headboard H (FIG. 3), the second connector member 102 of each bracket 30 is slid a lesser distance into its respective first connector member 101. The latter occurs simply because of the differences in width of the beds. However, in each case once the second connector member 102 has been slid into its respective first connector member 101, the height of each second bracket assembly 32 and its associated mounting plate member 90 corresponds to the height of each first bracket member 31 and the pivot axes P1, P2 are in vertical parallel relationship to each other. The headboard H (FIGS. 3 and 5) is then positioned with the legs L, L of the headboard H against each mounting plate member 90 and each mounting plate member 90 is located identical distances width-wise of the legs L, L. Since the headboards H are at this time spaced a considerable distance from the head crossbar 23, various assembly manipulations are readily performed absent interference from the main frame 21, the mattress M, the headboard H or the legs L, L thereof. The set screws 105 can be tightened to guard against relative slippage of the connector assemblies 33, 33 which assures that the relationships of the mounting plate members 90 to the legs L, L is maintained during the remainder of the assembly process.

Since the bed B is on casters and the assembly process thus far described has assumed that the bottom edges (unnumbered) of the headboard legs L, L rest upon a supporting surface S (FIG. 2), each leg L, L must be necessarily raised above the supporting surface S an identical distance which is readily accomplished utilizing, for example, wedges, spacers, shims, etc. Once elevated, two vertical holes are drilled in each leg L, L substantially centrally of the elongated openings or slots 91, 91 of each mounting plate 90 and appropriate bolts B and nuts N (FIGS. 3 and 4) are used in a conventional manner to firmly connect each mounting plate member 90 and thus each second bracket assembly 32 to an associated leg L of the headboard H. At this point, the shims or spacers can be removed and the bottom edge (unnumbered) of each leg L remains spaced above the supporting surface S in the manner illustrated best in FIG. 2 of the drawings. The headboard H is also spaced relatively distant from the headboard crossbar 23 of the main frame 21 (FIGS. 3 and 5). The assembly is completed by slightly backing-off the set screws 105 and pushing the headboard H toward the headboard crossbar 23 which simultaneously pushes the second connector members 102 further into the first connector members 101 while simultaneously relative pivoting occurs between the first and second bracket members 41, 42 of each of the members 41, 42 of each of the first bracket assemblies 31 about the first pivot axes P1 and similar pivoting of the third and fourth bracket members 61, 62 of each of the second bracket assemblies 32 about the pivot axes P2 eventually resulting in the in-use position shown in FIG. 4 in which the headboard H is substantially parallel to and closely adjacent the bedframe 21 and is in parallel relationship to the head cross bar 23 and the second connector members 102, 102 of each of the connector assemblies 33 whose axes are now in coaxial relationship to each other. Each of the set screws 105 is firmly tightened and the assembly is complete (phantom lines of FIGS. 1 and 4) in an efficient, quick, uncomplicated manner irrespective of the bed size (singe, queen, king, etc.) involved.

Although a preferred embodiment of the invention has been specifically illustrated and described herein, it is to be understood that minor variations may be made in the apparatus without departing from the spirit and scope of the invention, as defined by the appended claims.

What is claimed is:

1. A bracket adapted to secure a headboard to a bed frame comprising a first bracket assembly, a second bracket assembly and a connector assembly for selectively variably connecting said first and second bracket assemblies to each other; said first bracket assembly including first and second bracket members, first pivot means for connecting said first and second bracket members for pivoting movement relative to each other about a first pivot axis, said second bracket assembly including third and fourth bracket members, second pivot means for connecting said third and fourth bracket members for pivoting movement relative to each other about a second pivot axis, said connector assembly including first and second connector members, means for connecting said first connector member to one of said first and second bracket members, means for connecting said second connector member to one of said third and fourth bracket members, means for connecting the other of said first and second bracket members to one of a headboard and bed frame, means for connecting the other of said third and fourth bracket members to the other of a headboard and a bed frame, and means for selectively variably adjustably connecting said first and second connector members to each other.

2. The bracket as defined in claim 1 wherein said first and second pivot axes are disposed in substantially parallel relationship to each other.

3. The bracket as defined in claim 1 wherein at least one of said first through fourth bracket members is of a substantially U-shaped configuration.

4. The bracket as defined in claim 1 wherein at least two of said first through fourth bracket members is of a substantially U-shaped configuration.

5. The bracket as defined in claim 1 wherein at least three of said first through fourth bracket members is of a substantially U-shaped configuration.

6. The bracket as defined in claim 1 wherein each of said first through fourth of said first through fourth bracket members is of a substantially U-shaped configuration.

7. The bracket as defined in claim 1 wherein said first and second connector members are in relatively slidable relationship to each other.

8. The bracket as defined in claim 1 wherein said means for selectively variably adjustably connecting said first and second connector members includes a slidable connection between said first and second connector members.

9. The bracket as defined in claim 1 wherein said means for selectively variably adjustably connecting said first and second connector members includes a slidable connection between said first and second connector members, and means for fixing said first and second connector members in selectively varied positions of adjustment relative to each other.

10. The bracket as defined in claim 1 including means for preventing relative rotation between said first and second connector members.

11. The bracket as defined in claim 1 wherein said means for selectively variably adjustably connecting said first and second connector members includes a slidable connection between said first and second connector members, and means for preventing relative rotation between said first and second connector members.

12. The bracket as defined in claim 1 wherein said means for selectively variably adjustably connecting said first and second connector members includes a slidable connection between said first and second connector members, and said slidable connection is a telescopic connection between said first and second connector members.

13. The bracket as defined in claim 1 wherein said means for selectively variably adjustably connecting said first and second connector members includes a slidable connection between said first and second connector members, said slidable connection is a telescopic connection between said first and second connector members, and screw means for locking said first and second connector members relative to each other.

14. The bracket as defined in claim 2 wherein at least one of said first through fourth bracket members is of a substantially U-shaped configuration.

15. The bracket as defined in claim 2 wherein at least two of said first through fourth bracket members is of a substantially U-shaped configuration.

16. The bracket as defined in claim 2 wherein said first and second connector members are in relatively slidable relationship to each other.

17. The bracket as defined in claim 2 wherein said means for selectively variably adjustably connecting said first and second connector members includes a slidable connection between said first and second connector members, and means for fixing said first and second connector members in selectively varied positions of adjustment relative to each other.

18. The bracket as defined in claim 2 including means for preventing relative rotation between said first and second connector members.

19. The bracket as defined in claim 2 wherein said means for selectively variably adjustably connecting said first and second connector members includes a slidable connection between said first and second connector members, and said slidable connection is a telescopic connection between said first and second connector members.

20. The bracket as defined in claim 3 wherein at least two of said first through fourth bracket members is of a substantially U-shaped configuration.

21. The bracket as defined in claim 3 wherein said first and second connector members are in relatively slidable relationship to each other.

22. The bracket as defined in claim 3 including means for preventing relative rotation between said first and second connector members.

23. The bracket as defined in claim 14 wherein said first and second connector members are in relatively slidable relationship to each other.

24. The bracket as defined in claim 15 wherein said first and second connector members are in relatively slidable relationship to each other.

* * * * *